US008992273B2

(12) United States Patent
Winiski et al.

(10) Patent No.: US 8,992,273 B2
(45) Date of Patent: Mar. 31, 2015

(54) CABLE STEERING SYSTEM FOR A MARINE VESSEL WHICH HAS A PRIMARY PROPULSION UNIT AND AN AUXILIARY PROPULSION UNIT

(75) Inventors: Steven Winiski, Vancouver (CA); Brian Dudra, Vancouver (CA)

(73) Assignee: Marine Canada Acquisition Inc., Richmond (CA)

( * ) Notice: Subject to any disclaimer, the term of this patent is extended or adjusted under 35 U.S.C. 154(b) by 198 days.

(21) Appl. No.: 13/442,747

(22) Filed: Apr. 9, 2012

(65) Prior Publication Data

US 2012/0247381 A1 Oct. 4, 2012

Related U.S. Application Data

(63) Continuation-in-part of application No. 12/501,332, filed on Jul. 10, 2009, now Pat. No. 8,151,723.

(51) Int. Cl.
*B63H 25/10* (2006.01)
*B63H 20/12* (2006.01)

(52) U.S. Cl.
CPC ..... *B63H 20/12* (2013.01)
USPC ..... 440/62; 114/144 R

(58) Field of Classification Search
CPC ..... B63H 20/12; B63H 20/10; B63H 20/08; B63H 2770/00
USPC ... 440/53, 61 S, 61 B, 61 C, 61 T, 61 F, 61 G, 440/62, 63; 114/144 R
See application file for complete search history.

(56) References Cited

U.S. PATENT DOCUMENTS

| | | | | |
|---|---|---|---|---|
| 3,756,186 | A | 9/1973 | Nordling | |
| 3,863,593 | A * | 2/1975 | Borst et al. | 440/59 |
| 4,009,678 | A | 3/1977 | North | |
| 4,300,888 | A | 11/1981 | Warning | |
| 4,311,471 | A | 1/1982 | Queen | |
| 4,573,930 | A | 3/1986 | Queen | |
| 4,710,141 | A | 12/1987 | Ferguson | |
| 4,836,812 | A | 6/1989 | Griffiths | |
| 5,108,321 | A | 4/1992 | Nelson | |
| 5,154,651 | A | 10/1992 | Binversie et al. | |
| 6,224,438 | B1 | 5/2001 | Hase | |
| 6,276,977 | B1 * | 8/2001 | Treinen et al. | 440/61 R |
| 6,406,340 | B1 | 6/2002 | Fetchko et al. | |
| 6,413,126 | B1 | 7/2002 | Johnson | |
| 7,128,626 | B2 | 10/2006 | Dudra et al. | |
| 7,128,627 | B2 * | 10/2006 | Ferguson | 440/61 S |
| 8,151,723 | B2 | 4/2012 | Winiski et al. | |

FOREIGN PATENT DOCUMENTS

CA 2100214 A1 * 1/1995 ..... B63H 25/00

* cited by examiner

*Primary Examiner* — S. Joseph Morano
*Assistant Examiner* — Anthony Wiest
(74) *Attorney, Agent, or Firm* — Cameron IP

(57) ABSTRACT

A steering system for a marine vessel which has a primary propulsion unit and an auxiliary propulsion unit is disclosed. In one embodiment, a cable extending through a tilt tube of the primary propulsion unit couples the primary propulsion unit to the auxiliary propulsion unit. In another embodiment, a cable extends through a support cable extending through a support rod of the primary propulsion unit couples the primary propulsion unit to the auxiliary propulsion unit.

12 Claims, 8 Drawing Sheets

CABLE STEERING SYSTEM FOR A MARINE VESSEL WHICH HAS A PRIMARY PROPULSION UNIT AND AN AUXILIARY PROPULSION UNIT

CROSS-REFERENCE TO RELATED APPLICATION

This application is a continuation-in-part application of application Ser. No. 12/501,332 filed in the United States Patent and Trademark Office on Jul. 10, 2009 now U.S. Pat. No. 8,151,723, and priority to which is claimed.

BACKGROUND OF THE INVENTION

1. Field of the Invention

The present invention relates to a steering system for a marine vessel and, in particular, to a steering system for a marine vessel which has a primary propulsion unit and an auxiliary propulsion unit.

2. Description of the Related Art

Marine vessels are often provided with a primary propulsion unit and an auxiliary propulsion unit. Typically a tie bar couples the primary propulsion unit and the auxiliary propulsion unit. U.S. Pat. No. 6,406,340 to Fetchko et al. and U.S. Pat. No. 7,128,626 to Dudra et al., the full disclosures of which are incorporated herein by reference, both disclose using a tie bar to couple a primary propulsion unit and an auxiliary propulsion unit. This allows the propulsion units to be steered simultaneously.

It is also known to use a cable to couple a primary propulsion unit and an auxiliary propulsion unit. U.S. Pat. No. 4,836,812 to Griffiths, the full disclosure of which is also incorporated herein by reference, discloses using a cable to couple a hydraulic cylinder of a primary propulsion unit to a steering arm of an auxiliary propulsion unit. Coupling the propulsion units with a cable provides the advantage of a flexible and rotatable connecting member. However, connecting the cable to the hydraulic cylinder of the primary propulsion engine may limit rotation of the cable and/or unduly twist the cable when primary propulsion unit is tilted. This may result in jamming and less motion being transmitted to the auxiliary propulsion unit.

There is accordingly a need for an improved steering system for a marine vessel which has a primary propulsion unit and an auxiliary propulsion unit.

SUMMARY OF THE INVENTION

It is an object of the present invention to provide an improved steering system for a marine vessel which has a first propulsion unit and a second propulsion unit.

In particular, it is an object of the present invention to provide an improved steering system for a marine vessel in which a cable couples a primary propulsion unit to an auxiliary propulsion unit.

There is accordingly provided a steering system which comprises a steering assembly for steering a first propulsion unit. The steering assembly includes an actuator for imparting steering movement to the first propulsion unit. A push/pull cable operatively connects the actuator to a second propulsion unit. The push/pull cable extends through a tilt tube of the first propulsion unit and is capable of transmitting steering movement from the actuator to the auxiliary propulsion unit. The first propulsion unit may be a primary propulsion unit and the second propulsion unit may be an auxiliary propulsion unit. The push/pull cable may extend through a tilt tube of the second propulsion unit.

There is further provided a steering system which comprises a transom bracket provided with a support rod having a passageway extending therethrough. A steering assembly for steering the first propulsion unit is mounted on the transom bracket. The steering assembly includes an actuator for imparting steering movement to the first propulsion unit. A push/pull cable extends between the first propulsion unit and a second propulsion unit for operatively connecting the actuator of the first propulsion unit to the second propulsion unit. The push/pull cable extends through the support rod and the push/pull cable is capable of transmitting steering movement from the actuator of the first propulsion unit to the second propulsion unit. The first propulsion unit may be a primary propulsion unit in the form of a stern drive and the second propulsion unit may be an auxiliary propulsion unit in the form of an outboard motor.

The steering system may be mounted on the transom bracket. The push/pull cable may extend through a tilt tube of the second propulsion unit. A connecting arm may operatively connect the push/pull cable to the actuator of the first propulsion unit. A steering arm may operatively connect the push/pull cable to a steering member of the second propulsion unit. The actuator of the first propulsion unit may include a hydraulic cylinder having a piston rod reciprocatingly mounted therein. The support rod and the piston rod may be substantially parallel. At least a portion of the push/pull cable is coaxial with the support rod. At least a portion of the push/pull cable is coaxial with the tilt tube of the second propulsion unit.

There is still further provided a method for coupling a first propulsion unit to a second propulsion unit. One embodiment of the method comprises:

providing a support rod of the first propulsion unit with an axial passageway which extends therethrough;

providing a tilt tube of the second propulsion unit with an axial passageway which extends therethrough;

connecting a push/pull cable to a steering assembly of the first propulsion unit;

extending the push/pull cable through the passageway in the support rod and the passageway in the tilt tube of the second propulsion unit; and steeringly connecting the push/pull cable to the second propulsion unit so that the push/pull cable is capable of transmitting steering movement from the actuator of the first propulsion unit to the second propulsion unit.

BRIEF DESCRIPTION OF DRAWINGS

The invention will be more readily understood from the following description of following embodiments thereof given, by way of example only, with reference to the accompanying drawings, in which.

DESCRIPTIONS OF THE PREFERRED EMBODIMENTS

Figure 1:
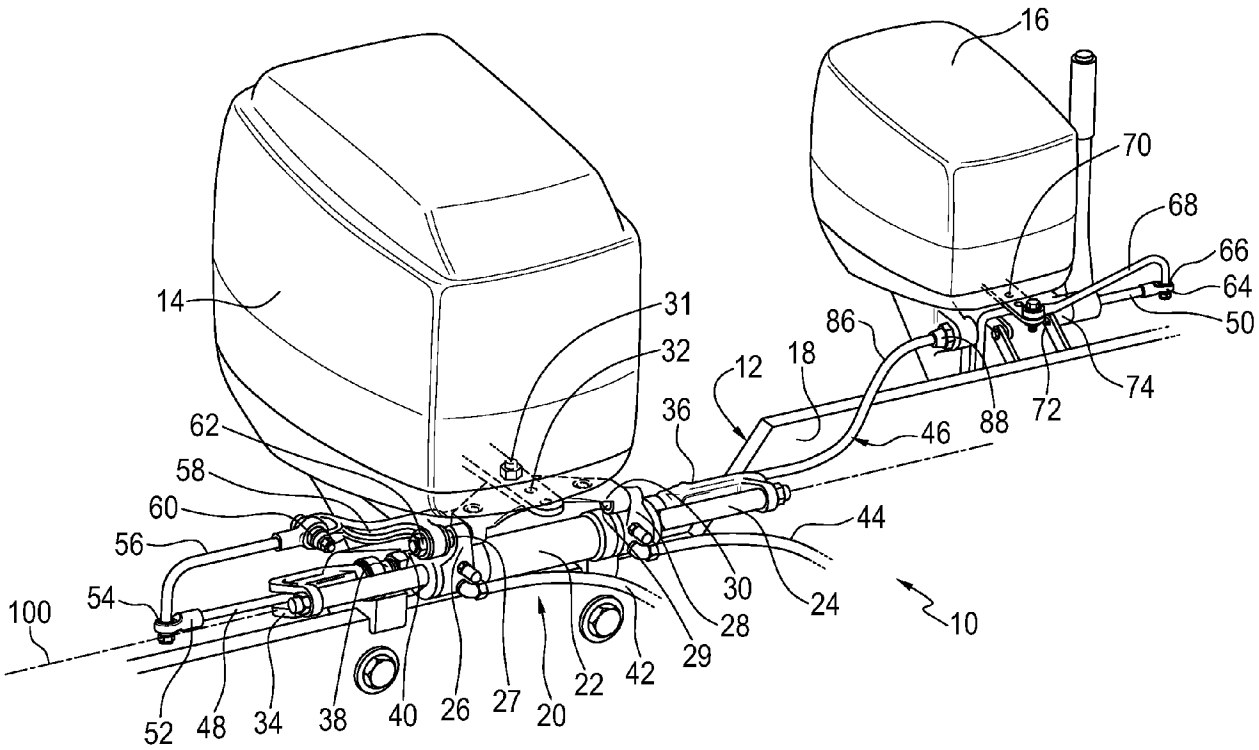
FIG. 1 is a front perspective view of a first embodiment of an improved steering system for a marine vessel which has a primary propulsion unit and an auxiliary propulsion unit.

Referring to the drawings and first to FIG. 1, this shows a first embodiment of a steering system 10 for a marine vessel 12 which is shown in fragment. The marine vessel 12 is provided with a first propulsion unit in the form of a primary propulsion unit 14 and a second propulsion unit in the form of an auxiliary propulsion unit 16. The propulsion units 14 and 16 are both mounted on a stern 18 of the marine vessel 12. The steering system 10 couples the propulsion units 14 and 16. In this example, the primary propulsion unit 14 and auxiliary propulsion unit 16 are both outboard engines. The primary propulsion unit 14 allows an operator to operate the marine vessel 12 at high speeds for recreational activities such as travelling to fishing destinations. The auxiliary propulsion unit 16 allows the operator to operate the marine vessel 12 at low speeds for recreational activities such as trolling. In other embodiments, a pair of inboard/outboard engines may be twinned or an outboard engine may be coupled to a stern drive.

Figure 2:
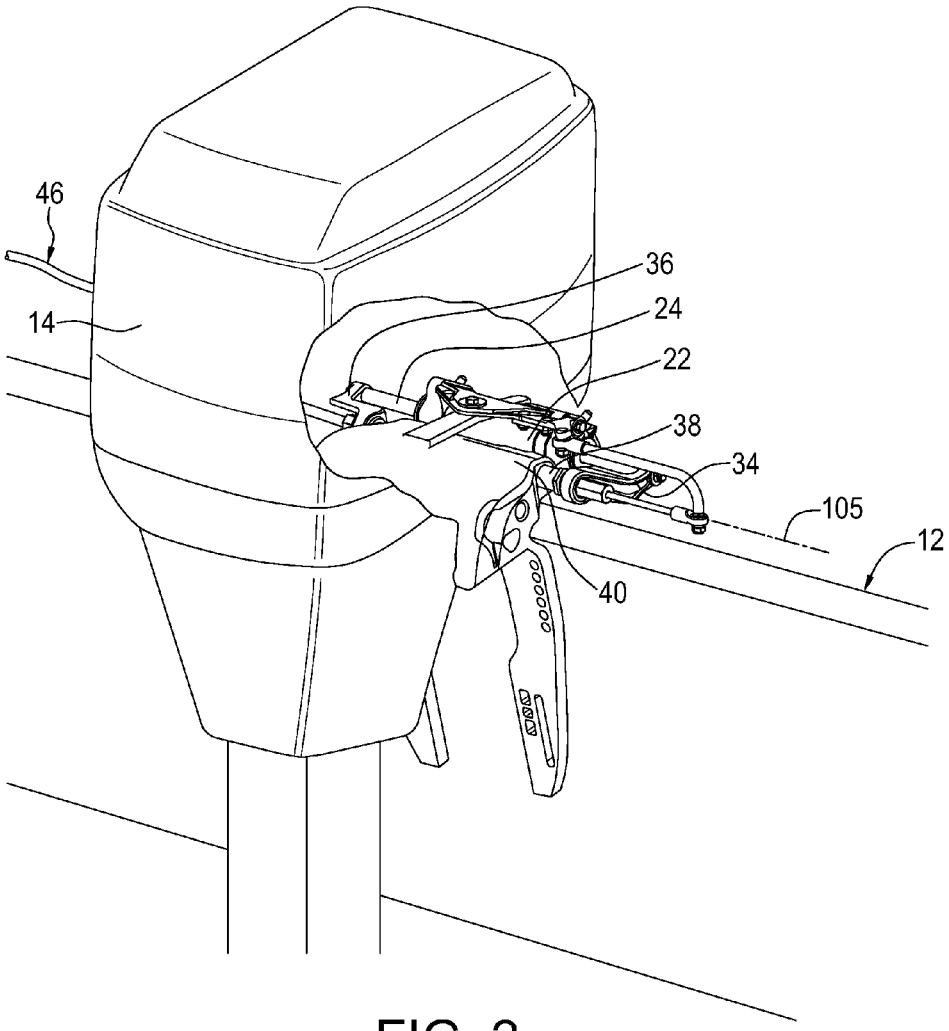
FIG. 2 is a partially broken, back perspective view of the primary propulsion unit of FIG. 1.

The steering system 10 includes a hydraulic steering assembly 20 which steers the primary propulsion unit 14. The steering assembly 20 includes an actuator in the form of hydraulic cylinder 22 with a piston rod 24 reciprocatingly mounted therein allowing for relative movement of the cylinder 22 along a piston rod axis 100. The cylinder 22 has a pair of spaced-apart cylinder arms 26 and 28 which extend radially outward of the cylinder 22. A pivot plate 30 is pivotably connected to each of the cylinder arms 26 and 28 by means of pivot pins 27 and 29, respectively. The pivot plate 30 extends between the cylinder arms 26 and 28 and can pivot about the pins 27 and 29. A steering member or tiller 32 of the primary propulsion unit 14 is pivotably connected to the pivot plate 30 by a pivot pin 31. Support arms 34 and 36 connect respective ends of the piston rod 24 to a support rod 38 of a tilt tube 40 of the primary propulsion unit 14. This is better shown in FIG. 2. The support arms 34 and 36 restrict axial movement of the piston rod 24 relative to the marine vessel 12. The support arms 34 and 36 also allow arcuate movement of the cylinder 22 and piston rod 24, about a tilt axis 105, while maintaining the piston rod axis parallel to the tilt axis 105.

Referring back to FIG. 1, hydraulic conduits 42 and 44 hydraulically connect opposite ends of the cylinder 22 to a helm pump (not shown). Hydraulic fluid pumped from the helm pump actuates the cylinder 22 to reciprocate linearly relative to the piston rod 24 as is well known in the art. The piston rod 24 remains axially stationary relative to the marine vessel 12 while the cylinder 22 reciprocates linearly relative to the marine vessel 12. This relative linear movement of the cylinder 22 causes the tiller 32 of the primary propulsion unit 14 to pivot, thereby causing the primary propulsion unit 14 to be steered. As thus far described the steering assembly 20 is conventional and accordingly will not be described in further detail herein.

The relative linear movement of the cylinder 22 is also transmitted by a connecting member, in the form of a push/pull cable 46, to the auxiliary propulsion unit 16, thereby causing the auxiliary propulsion unit 16 to be steered. The push/pull cable 46 is a conventional push/pull cable. The push/pull cable 46 is provided with cable rods 48 and 50 at opposite ends thereof. As shown in FIG. 1, a first one of the cable rods 48 threadedly engages a rod end 52 provided with an aperture or socket 54 which receives an L-shaped connecting arm 56. The connecting arm 56 is pivotably connected to a bracket 58 by a pivot pin 60. This allows the connecting arm 56 to pivot about an axis which is generally perpendicular to the piston rod axis 100. The bracket 58 is pivotably connected to the pivot plate 30 of the steering assembly 20 by a pivot pin 62 as shown in FIG. 1. This allows the bracket 58 to pivot about an axis which is generally parallel to the piston rod axis 100. A second one of the cable rods 50 threadedly engages a rod end 64 provided with an aperture or socket 66 which receives an L-shaped steering arm 68. The steering arm 68 is pivotably connected to a steering member or tiller 70 of the auxiliary propulsion unit 16 by a pivot pin 72. This allows the steering arm 68 to pivot about an axis which is generally perpendicular to the piston rod axis 100. The push/pull cable 46 thereby steeringly couples the propulsion units 14 and 16.

The push/pull cable 46 extends from the connecting arm 56, through both the tilt tube 40 of the primary propulsion unit 14 and a tilt tube 74 of the auxiliary propulsion unit 16, to the steering arm 68. In one embodiment the tilt tubes 40 and 74 are substantially aligned along a common horizontal axis. The push/pull cable 46 accordingly extends substantially linearly in the horizontal direction. However, the cable is also flexible, allowing it to curve if required, for example, if the tilt tubes 40 and 74 are not aligned. The bend shown in FIG. 1 is exaggerated for purposes of illustration.

Figure 3:
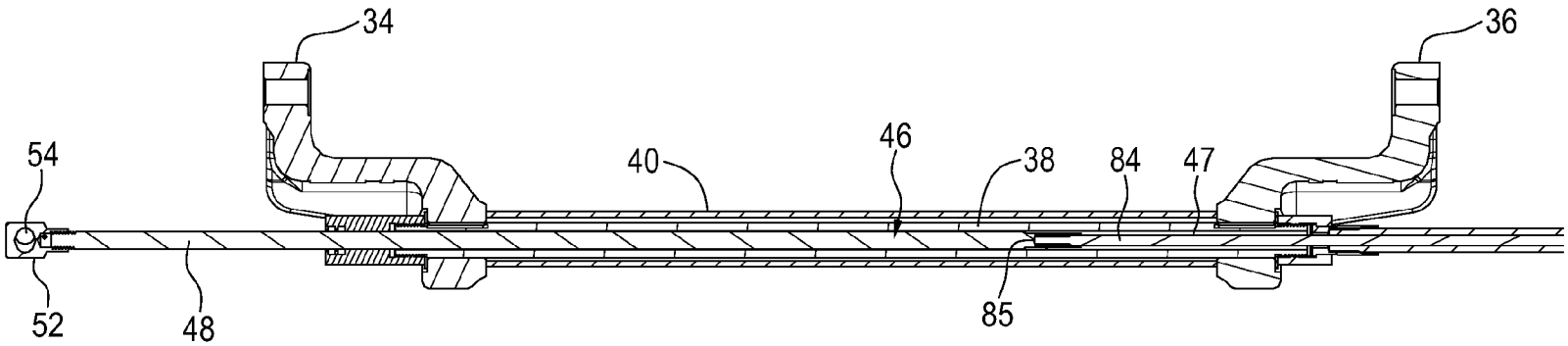
FIG. 3 is a sectional view showing a push/pull cable extending through a support rod which in turn extends through a tilt tube of the primary propulsion unit of FIG. 1.

Referring now to FIG. 3, this shows a cross-sectional view of the tilt tube 40 of the primary propulsion unit 14. The tilt tube 40 is hollow and the support rod 38 extends through the tilt tube 40. The support rod 38 is also hollow, or bored out, and the push/pull cable 46 extends through a central, axially passageway or a bore 47 of the support rod 38. As better shown in FIGS. 4 and 5, the support rod 38 extends axially beyond the tilt tube 40 and is provided with threads 76 and 78 at each end thereof. This allows the support rod 38 receive the support arms 34 and 36 as described above. End caps 80 and 82 threadedly engage the support rod 38 to secure the support arms 34 and 36 in position.

Figure 4:
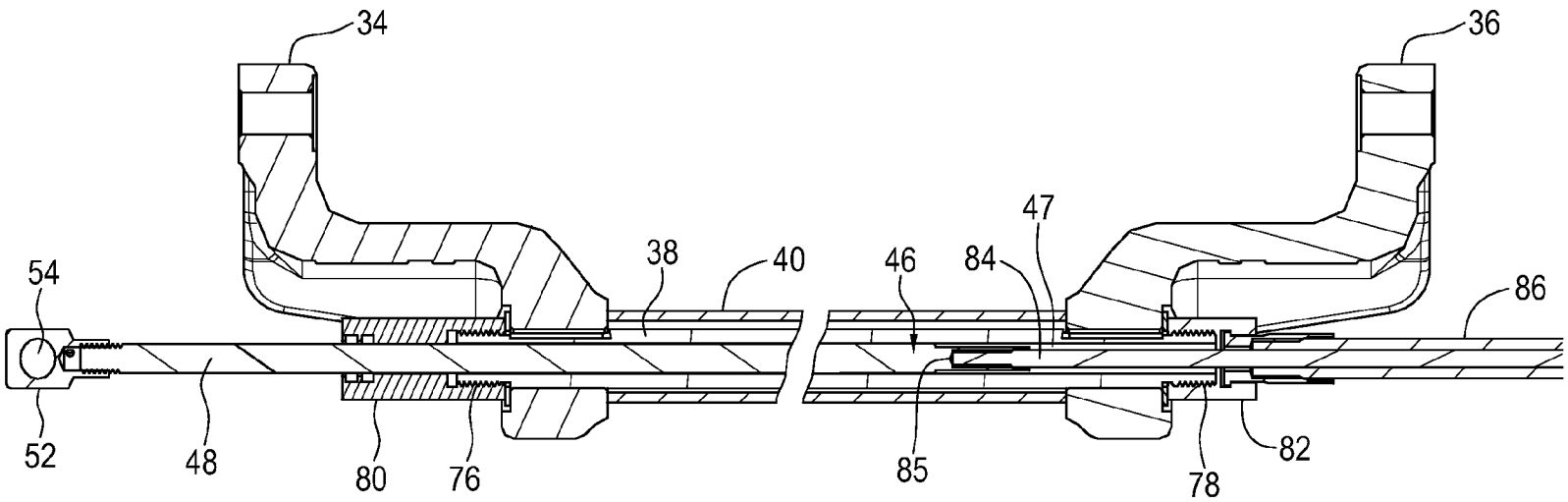
FIG. 4 is a fragmentary, sectional view showing ends of the tilt tube of FIG. 3 in greater detail.
Figure 5:
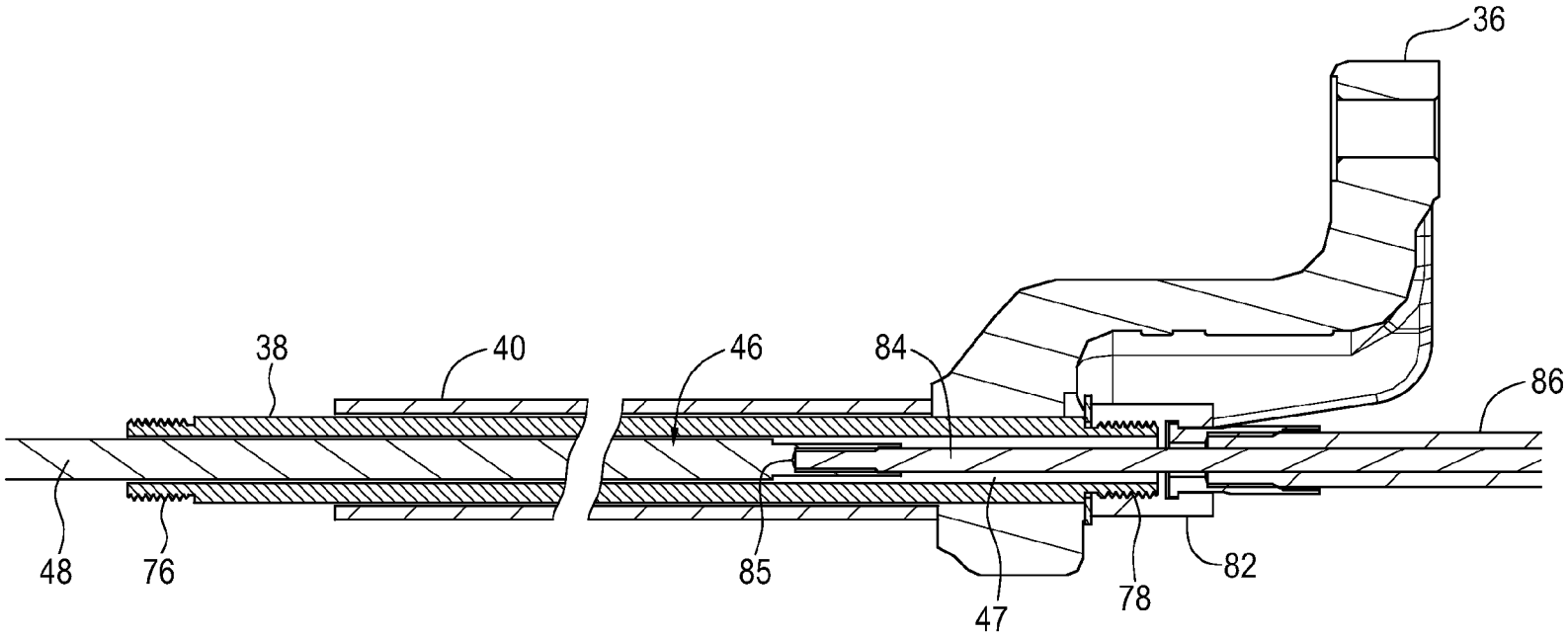
FIG. 5 is a fragmentary, sectional view showing an end of the support rod of FIG. 3 in greater detail.

The push/pull cable 46 also has a cable portion 84. The cable portion 84 extends between the cable rods 48 and 50. As seen in FIGS. 4 and 5 for the first cable rod 48, each cable rod has a bore 85 at the end adjacent to the cable portion 84. The cable portion 84 is received within the bore 85 and is crimped in place in this example.

The push/pull cable 46 further includes an outer sleeve or jacket 86 which extends between the propulsion units 14 and 16 and, at least partially, houses the cable portion 84. As shown in FIGS. 4 and 5, in this example, the jacket 86 is connected to an end cap 82 of the support rod of the primary propulsion unit. Similarly, and as shown in FIG. 1, the jacket 86 is also connected to an end cap 88 of the auxiliary propulsion unit 16. The cable portion 84 is able to reciprocate within the jacket 86 and transmits linear movement from the first cable rod 48 to the second cable rod 50.

In operation, an operator steers the primary propulsion unit 14 by actuating the helm pump to pump hydraulic fluid to the cylinder 22 of the steering system 20. This causes the cylinder 22 to reciprocate linearly with respect to the marine vessel 12 as described above. This relative linear movement of the cylinder 22 causes the tiller 32 of the primary propulsion unit 14 to pivot, thereby causing the primary propulsion unit 14 to be steered. The relative linear movement of the cylinder 22 is also transmitted to the auxiliary propulsion unit 16, thereby causing the auxiliary propulsion unit 16 to be steered. In particular, the relative linear movement of the cylinder 22 is transmitted through the bracket 58 and connecting arm 56 to the first cable rod 48 of the push/pull cable 46. This causes the first cable rod 48 to move linearly. The linear movement of the first cable rod 48 is transmitted through the cable portion 84 of the push/pull cable 46 to the second cable rod 50. This cause the second cable rod 50 to move linearly. Movement of the second cable rod 50, through the steering arm 68, causes the tiller 70 of the auxiliary propulsion unit 14 to pivot thereby causing the auxiliary propulsion unit to be steered.

Extending the push/pull cable 46 through tilt tubes 40 and 74 and, in particular through the support rods of the tilt tubes, allows for independent tilting of the primary propulsion unit 14 and the auxiliary propulsion unit 16. Furthermore, twisting of the push/pull cable 46 is minimized.

Figure 6:
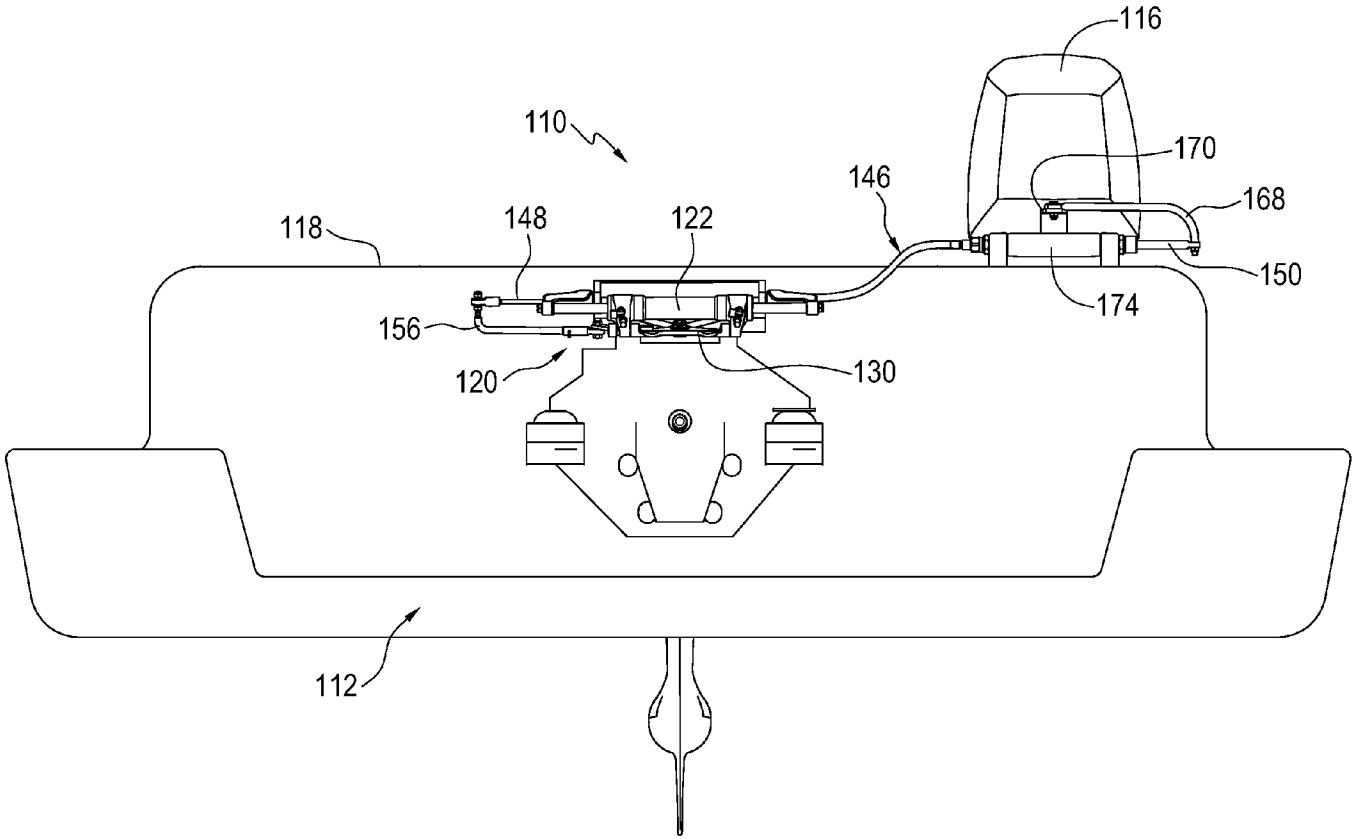
FIG. 6 is a front elevation view of a second embodiment of an improved steering system for a marine vessel which has a primary propulsion unit and an auxiliary propulsion unit.
Figure 7:
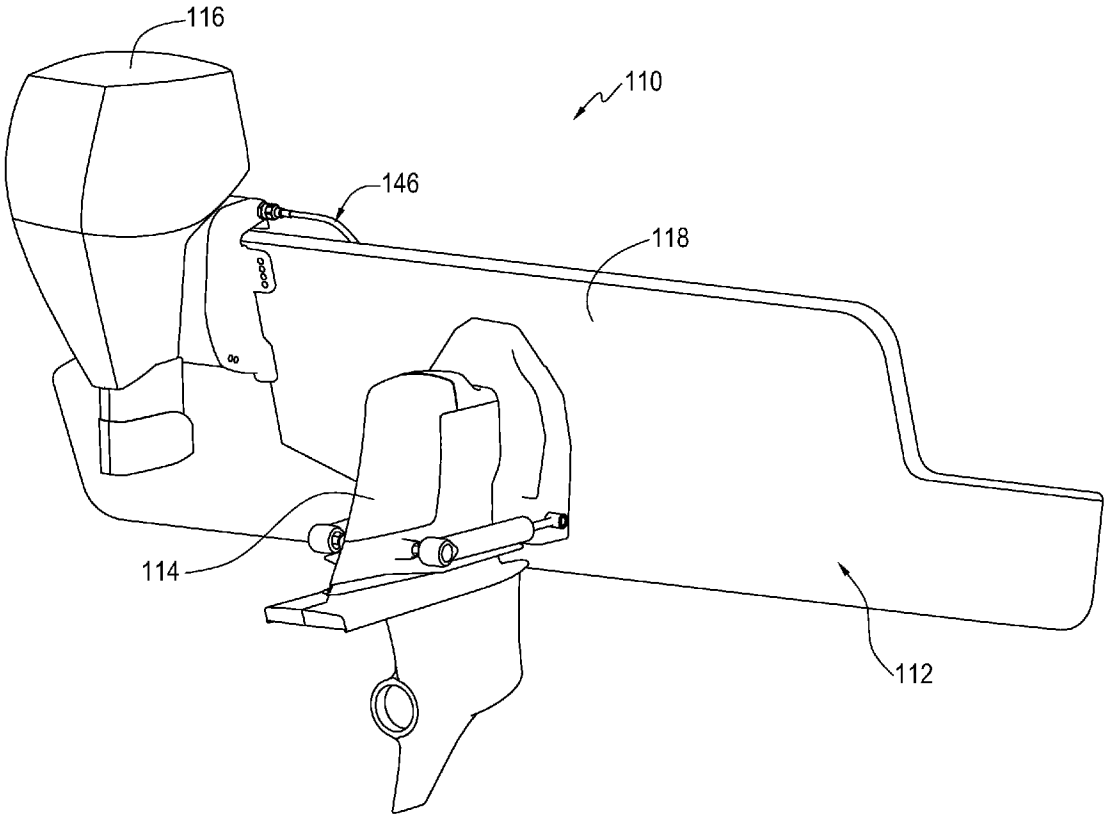
FIG. 7 is a side, rear perspective view of the steering system of FIG. 6 showing the primary propulsion unit and the auxiliary propulsion unit.
Figure 8:
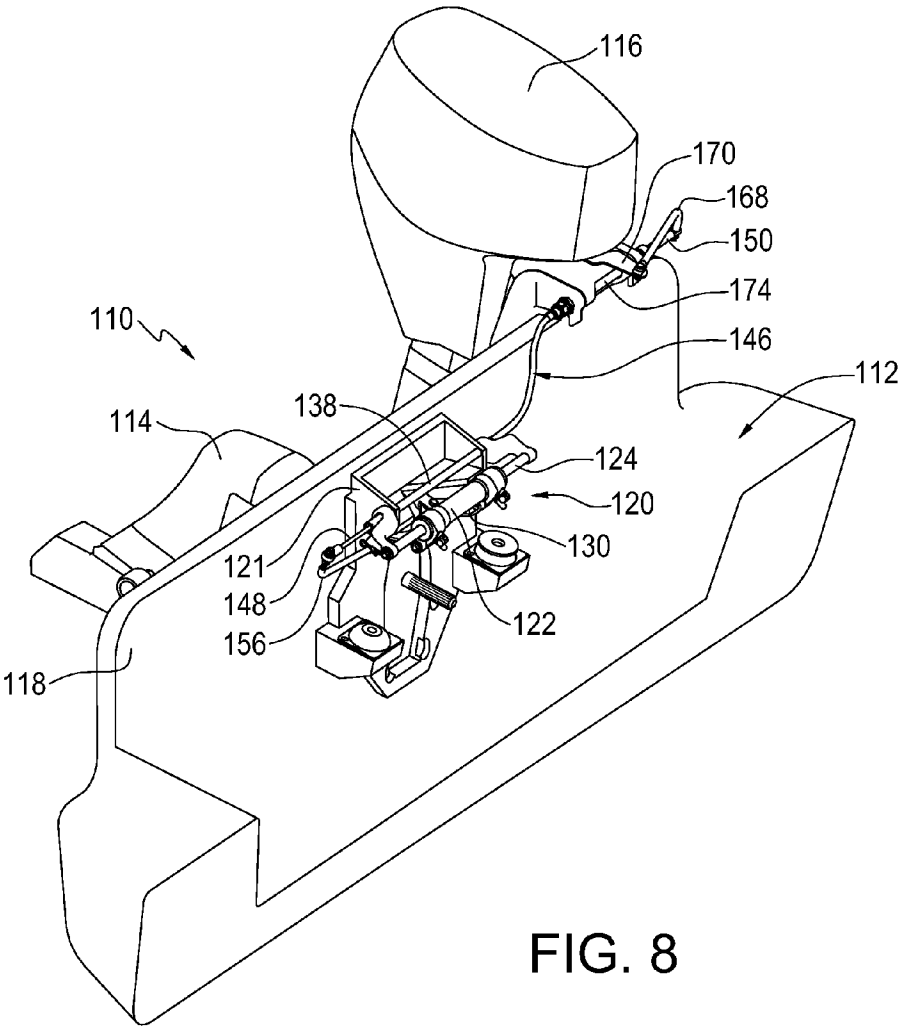
FIG. 8 is a side, front perspective view of the steering system of FIG. 6.

Referring now to FIGS. 6 to 8, these show a second embodiment of a steering system 110 for a marine vessel 112 which is shown in fragment. The marine vessel 112 is provided with a first propulsion unit in the form of a primary propulsion unit 114 and a second propulsion unit in the form of an auxiliary propulsion unit 116. The propulsion units 114 and 116 are both mounted on a stern 118 of the marine vessel 112. In this example, the primary propulsion unit 114 is a stern drive and the auxiliary propulsion unit 116 is an outboard motor. The steering system 110 also includes a hydraulic steering assembly 120, best shown in FIG. 8, which steers the primary propulsion unit 114. The hydraulic steering assembly 120 is substantially similar to the hydraulic steering assembly 20 shown in FIG. 1 and is accordingly not described in detail herein except with respect to the differences therebetween. It will be understood however by a person skilled in the art that in the hydraulic steering system 20 shown in FIG. 1 the pivot plate 30 is positioned above the hydraulic cylinder 22, while in the hydraulic steering assembly 120, best shown in FIG. 8, a pivot plate 130 is positioned below the hydraulic cylinder 122.

The hydraulic steering assembly 120 is mounted on mounting bracket which is a transom bracket 121 in this example. The transom bracket 121 is provided with a support rod 138 as best shown in FIG. 8. There is a central, axial passageway extending through the support rod 138 similar to central, axial passageway 47 of the support rod 38 shown in FIGS. 3 and 4. The support rod 138 extends substantially parallel to a piston rod 124 of the steering assembly 120. A push/pull cable 146 extends from the primary propulsion unit 114, through the support rod 124, to the auxiliary propulsion unit 116. The push/pull 146 cable is substantially similar to the push/pull cable 46 of FIGS. 1 to 5 and is provided with cable rods 148 and 150 at opposite ends thereof. A first one of the cable rods 148 is coupled to the hydraulic steering assembly 120 of the primary propulsion unit 114 and a second one of the cable rods 150 is coupled to a steering member or tiller 170 of the auxiliary propulsion unit 116. In particular, the cable rods 148 and 150 are respectively connected to the primary propulsion unit 114 and auxiliary propulsion unit 116 in a manner substantially similar as described above for the steering system shown in FIG. 1. The first one of the cable rods 148 is connected to an L-shaped connecting arm 156 of the hydraulic steering assembly 120 and the second one of the cable rods 150 is connected to an L-shaped steering arm 168 which is pivotably connected to the tiller 170 of the auxiliary propulsion unit 116. The push/pull cable 146 also extends through a tilt tube 174 of the auxiliary propulsion unit 116.

Accordingly, the steering system disclosed herein may be retrofitted to existing marine vessels by boring through the tilt tubes of existing propulsion units or by providing support rods for the tilt tubes with central passageways or bores to receive a push/pull cable. For example, the steering system disclosed herein may be retrofitted to the SEA STAR® steering system.

It will further be understood by a person skilled in the art that many of the details provided above are by way of example only, and are not intended to limit the scope of the invention which is to be determined with reference to the following claims.

What is claimed is:

1. A steering system for a marine vessel having a first propulsion unit and a second propulsion unit, the steering system comprising:

a steering assembly for steering the first propulsion unit, the steering assembly including an actuator for imparting steering movement to the first propulsion unit; and a push/pull cable, comprised of a cable portion and a jacket which at least partially houses the cable portion and allows the cable portion to reciprocate within the jacket, the push/pull cable extending between the first propulsion unit and the second propulsion unit for operatively connecting the actuator of the first propulsion unit to the second propulsion unit, the push/pull cable extending through a tilt tube of the first propulsion unit, and the push/pull cable being capable of transmitting steering movement from the actuator of the first propulsion unit to the second propulsion unit.

2. The steering system as claimed in claim 1 wherein the push/pull cable extends through a tilt tube of the second propulsion unit.

3. A steering system for a marine vessel having a first propulsion unit and a second propulsion unit, the steering system comprising:

a transom bracket provided with a support rod having an axial passageway extending therethrough;

a steering assembly for steering the first propulsion unit mounted on the transom bracket, the steering assembly including an actuator for imparting steering movement to the first propulsion unit; and a push/pull cable, comprised of a cable portion and a jacket which at least partially houses the cable portion and allows the cable portion to reciprocate within the jacket, the push/pull cable extending between the first propulsion unit and the second propulsion unit for operatively connecting the actuator of the first propulsion unit to the second propulsion unit, the push/pull cable extending through the support rod, and the push/pull cable being capable of transmitting steering movement from the actuator of the first propulsion unit to the second propulsion unit.

4. The steering system as claimed in claim 3 wherein the push/pull cable further extends through a tilt tube of the second propulsion unit.

5. The steering system as claimed in claim 4 wherein at least a portion of the push/pull cable is coaxial with the tilt tube of the second propulsion unit.

6. The steering system as claimed in claim 3 wherein a connecting arm operatively connects the push/pull cable to the actuator of the first propulsion unit.

7. The steering system as claimed in claim 3 wherein a steering area operatively connects the push/pull cable to a steering member of the second propulsion unit.

8. The steering system as claimed in claim 3 wherein the actuator of the first propulsion unit includes a hydraulic cylinder having a piston rod reciprocatingly mounted therein.

9. The steering system as claimed in claim 8 wherein the support rod and the piston rod are substantially parallel.

10. The steering system as claimed in claim 3 wherein at least a portion of the push/pull cable is coaxial with the support rod.

11. The steering system as claimed in claim 3 wherein the first propulsion unit is a stern drive and the second propulsion unit is an outboard motor.

12. A method for coupling a first propulsion unit of a marine vessel to a second propulsion unit of the marine vessel, the method comprising the steps of:

providing a support rod of the first propulsion unit with an axial passageway which extends therethrough;

providing a tilt tube of the second propulsion unit with an axial passageway which extends therethrough;

providing a push/pull cable comprised of a cable portion and a jacket which at least partially houses the cable portion and allows the cable portion to reciprocate within the jacket;

connecting a push/pull cable to a steering assembly of the first propulsion unit;

extending the push/pull cable through the axial passageway in the support rod of the first propulsion unit and the axial passageway in the tilt tube of the second propulsion unit;

steeringly connecting the push/pull cable to the second propulsion unit so that the push/pull cable is capable of transmitting steering movement from the actuator of the first propulsion unit to the second propulsion unit.

* * * * *

UNITED STATES PATENT AND TRADEMARK OFFICE

CERTIFICATE OF CORRECTION

PATENT NO. : 8,992,273 B2
APPLICATION NO. : 13/442747
DATED : March 31, 2015
INVENTOR(S) : Steven Winiski et al.

It is certified that error appears in the above-identified patent and that said Letters Patent is hereby corrected as shown below:

In the Claims

Replace “area” at column 6, line 63, with “arm”.

Signed and Sealed this
Twenty-third Day of June, 2015

Michelle K. Lee

Michelle K. Lee
*Director of the United States Patent and Trademark Office*